United States Patent [19]

Knutar

[11] Patent Number: 4,721,397

[45] Date of Patent: Jan. 26, 1988

[54] FLEXIBLE RECEPTACLE FOR FLUIDS

[75] Inventor: Alf Knutar, Karleby, Finland

[73] Assignee: Oy Fluid-Bag AB, Jakobstad, Finland

[21] Appl. No.: 889,936

[22] PCT Filed: Nov. 13, 1985

[86] PCT No.: PCT/FI85/00089

§ 371 Date: Jul. 15, 1986

§ 102(e) Date: Jul. 15, 1986

[87] PCT Pub. No.: WO86/02911

PCT Pub. Date: May 22, 1986

[30] Foreign Application Priority Data

Nov. 16, 1984 [FI] Finland ..... 844505

[51] Int. Cl.[4] ..... B65D 33/16

[52] U.S. Cl. ..... 383/70; 383/78; 383/109; 383/906

[58] Field of Search ..... 383/70, 71, 78, 53, 383/37, 109, 114, 123, 906; 229/3.5 MF; 206/446, 802, 525; 138/118.1, 109

[56] References Cited

U.S. PATENT DOCUMENTS

| | | | |
|---|---|---|---|
| 2,009,511 | 7/1935 | Nydegger | 383/70 |
| 3,038,811 | 6/1962 | Reading | 229/3.5 MF |
| 3,428,240 | 2/1969 | Morris | 383/71 |
| 3,556,390 | 1/1971 | Gould | 383/70 |
| 3,754,371 | 8/1973 | Walker, III | 383/70 |
| 4,007,761 | 2/1977 | Beckman | 138/118.1 |
| 4,422,215 | 12/1983 | Liekens et al. | 206/802 |
| 4,436,204 | 3/1984 | Sowinski | 383/71 |

FOREIGN PATENT DOCUMENTS

| | | | |
|---|---|---|---|
| 129100 | 12/1984 | European Pat. Off. | 206/802 |

*Primary Examiner*—Willis Little

*Attorney, Agent, or Firm*—Cesari and McKenna

[57] ABSTRACT

The present invention relates to a flexible receptacle for fluids, which receptacle comprises a cylindrical outer casing (1) and an inner bag. The casing is formed by a hose which is doubled up at one end of the receptacle so as to obtain a casing (1) with a double wall. The strength properties of the casing can be considerably improved if the casing in the portions positioned in the vicinity of the doubled end of the receptacle are twisted around the central axis of the receptacle with respect to the mantle face of the receptacle.

7 Claims, 5 Drawing Figures

FIG. 1
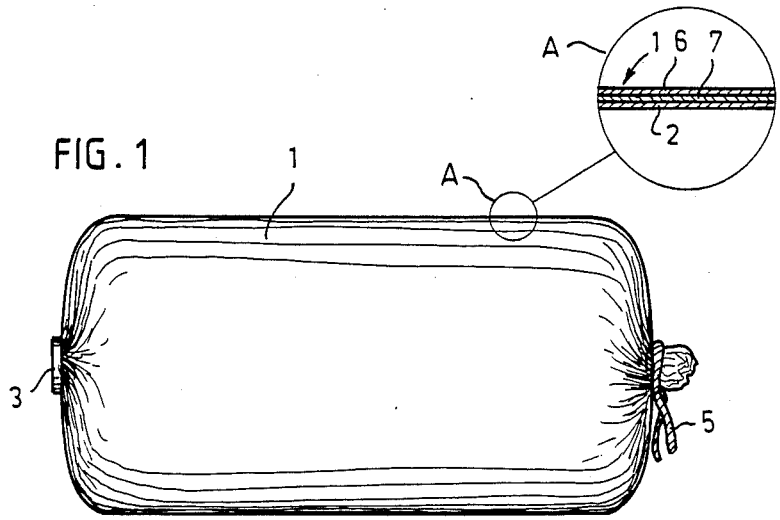
FIG. 2
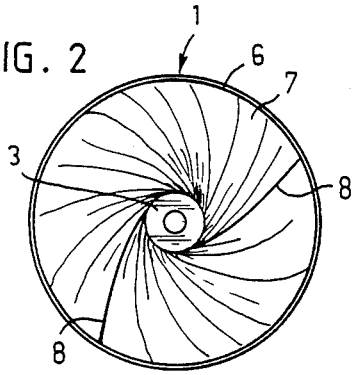
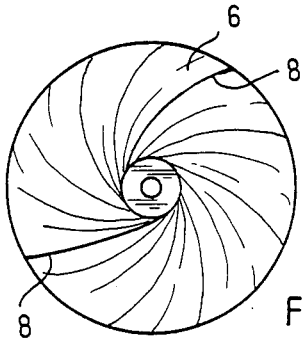
FIG. 3
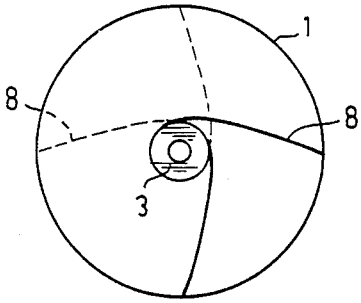
FIG. 4
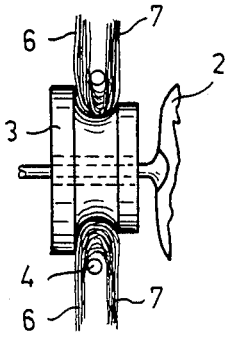
FIG. 5

FLEXIBLE RECEPTACLE FOR FLUIDS

BACKGROUND OF THE INVENTION

The present invention relates to a flexible receptacle for fluids, which receptacle comprises a substantially cylindrical outer casing and an inner bag positioned within said casing, said bag being provided with filling and emptying means, whereby said casing is formed by a hose which is doubled up at one end of the receptacle so as to obtain an outer casing with a double wall.

It is previously known to transport fluids, such as juice, cooking oil and wine, in large flexible receptacles of plastic, which receptacles are enclosed in a container during transportation. The receptacles are made of a fabric of high strength properties and impermeable to liquids and gases, which fabric is provided with an opening for a filling and emptying valve. Known receptacles involve such a high price that only if the same receptacle is used several times could this way of transportation be regarded as profitable. Consequently, the receptacle must be washed after having been emptied, then folded up and returned to the place of delivery to be refilled there.

Attempts have been made to produce disposable receptacles so as to avoid the above-mentioned steps which increase costs. Such receptacles consist of an outer casing of a durable material and an inner bag of a thin material, to which bag the filling and emptying valve is attached. The outer casing is provided with an opening for the valve. A problem which has prevented wide use of this kind of disposable receptacle is that the receptacles must be inexpensive but nevertheless of such a durability that they meet the requirements made of receptacles of this type.

It is previously known to manufacture large sacks for bulk goods by passing a hose-shaped circular fabric through a relatively small ring until the ring is positioned in the middle of the fabric and thereafter folding back that portion of the fabric which has been passed through the ring over the other portion, whereafter the end portions of the fabric are bound together with a knot. In this way, a sack is obtained which has a double wall and is very durable on account of the double wall and the absence of seams.

A sack manufactured in this way, however, has certain disadvantages. One disadvantage is that when the sack is filled, the ring is exposed to high radial forces directed outwards, which requires a high durability from the ring. The disadvantage is particularly prominent if the sack is replaced by a receptacle which is filled with a pressurized liquid. Another disadvantage is that the contact surface between the ring and the fabric extending therethrough exceeds 180°. As the fabric is pressed against the ring with a high force when the sack is full, a high friction is created between the ring and the fabric, which to a great extent prevents the fabric material from sliding through the ring. This prevents equalization of the stresses in the outer and inner walls of the sack when the sack is being filled up and when it is exposed to strains during transportation. In addition, folding up the fabric around the ring subjects the longitudinal warp threads of the fabric to a breaking effect which together with the high friction between the fabric and the ring easily causes breaking of the warp threads.

SUMMARY OF THE INVENTION

The object of the present invention is to provide a flexible receptacle for fluids, which receptacle is provided with a casing comprising a double wall manufactured in the way described above, but which avoids the disadvantages impairing large sacks manufactured in this way. The receptacle according to the invention is characterized in that said casing is in the portions positioned adjacent the folding line of the hose twisted around the central axis of the receptacle.

Essential advantages are unexpectedly achieved by twisting the casing in the portions positioned adjacent the folding line of the hose around the central axis of the receptacle. More specifically, it has turned out that in a receptacle, an end face formed in this way can temporarily increase the volume of the receptacle if the pressure exerted on the end face by the contents is momentarily increased. This maybe results from the fact that an end face wherein the casing is twisted around the central axis contains more hose material than an untwisted end face. By virtue of this flexibility of the end face, the casing can be made of a considerably weaker material than if no twisting is effected, which in turn reduces the manufacturing costs of the receptacle. Tests on the strength properties, in which a receptacle is dropped down on a surface, have shown that the casing usually bursts first in the area of the end face. By virtue of said twisting, the end is provided with a potential additional surface which can be brought into use at temporary peak loads.

The above advantage is particularly prominent if both the outer and the inner walls of the casing are in the twisted state.

According to one particularly preferred embodiment of the invention, the outer and inner walls of the casing are twisted in the same direction, i.e. if the inner wall is twisted clockwise viewed from the outside, the outer wall is twisted in the same direction, whereby the twisting angles are thus added up. In comparison with the known sack described above, an essential advantage is thereby obtained in that the ring through which the casing extends is exposed to radically reduced strains, and consequently, the friction between the casing and the ring is practically non-existent. As the strains of the ring are reduced, it can be replaced with a weaker and thus cheaper ring and, at best, with a simple rope, and as the friction between the casing material and the ring is reduced, the outer and inner walls of the casing are automatically adjusted under strain in such a manner that both of them are always exposed to equal strains, which also enables use of a casing material which is less durable than that previously used.

In said respect, the end of the receptacle operates in the best possible way if the outer and the inner wall are twisted to the same degree.

The twisting angle is of crucial importance for the achievement of the above-mentioned advantages. Even if said advantages occur with small twisting angles, a decisive effect is obtained when the total twisting angle for the outer and the inner wall ranges from 100° to 200°. Tests have shown that the maximum benefit is derived with a total twisting angle of 180°. In this case, the casing exerts no kind of pressure on the ring and the friction between the ring and the casing material is, accordingly, non-existent and the only task of the ring is thereby to hold together the end of the casing when the receptacle is empty.

With a large twisting angle, it is of advantage if the opening for filling and emptying means is positioned centrally at that end of the receptacle where the casing is doubled up and twisted around the central axis. In other words, if the filling and emptying valve is placed in the central opening, the casing material exerts a pressure on the periphery of the valve, on account of which the valve is maintained in place in the casing without any fastening means.

BRIEF DESCRIPTION OF THE DRAWINGS

One preferred embodiment of the receptacle according to the invention is more closely described in the following with reference to the attached drawing, wherein FIG. 1 is a side view of the receptacle according to the invention, FIG. 2 is an end view of the inner wall of the casing, FIG. 3 is an end view of the outer wall of the casing, FIG. 4 is an end view of the receptacle with two warp threads outlined, and FIG. 5 is a side view of the filling and emptying valve.

FIG. 1 illustrates an essentially cylindrical flexible receptacle for fluids, which receptacle comprises an outer casing 1 and an inner bag 2 positioned within the casing. Said bag 2, which is made of a thin flexible plastic, is attached to a valve 3 which is schematically shown in FIG. 5. The casing 1 consists of a durable fabric of plastic threads, the warp threads extending in the longitudinal direction of the receptacle and the weft threads in the peripheral direction.

The casing of the receptacle is made of a hose, the length of which is more than double as compared with the receptacle and which is folded at one end of the receptacle so as to provide a double-walled outer casing. The casing is formed in such a manner that the hose is drawn through a relatively small ring 4, (FIG. 5). When one half of the hose is drawn through the ring, that hose portion which is drawn through the ring is turned so that the inside is turned outwards and said portion is drawn over the rest of the hose until the both free ends of the hose are positioned at the same end of the receptacle, on the right in FIG. 1. The free end portions of the hose are bound together by means of a rope 5. In this way, a casing is obtained which has double walls, the outer wall being indicated by the reference numeral 6 and the inner wall by the numeral 7.

According to the invention, the outer and inner walls of the casing, at that end of the receptacle, where the casing is folded around the ring 4, are twisted around the central line of the receptacle as shown in FIGS. 2 and 3. The figures show the folds formed on twisting the end portions of the casing, while the lines 8, which are tangent to the periphery of the valve 3, also correspond to the direction of the warp threads of the casing.

FIG. 2 illustrates twisting of the inner wall 7 of the casing over about 90° around the central line of the receptacle, whereby the warp threads 8, which normally would have extended radially from the periphery of the receptacle towards the center, now extend tangent to the periphery of the valve. FIG. 3 illustrates how the warp threads 8 in the outer wall 6 of the casing extend obliquely with respect to the radius from the periphery of the valve to the periphery of the receptacle, because the outer wall 6 is also twisted at an angle of about 90° in the same direction as the inner wall 7.

FIG. 4 illustrates how a warp thread 8 extends from the periphery of the receptacle towards the center and again towards the periphery, whereby the broken line indicates the warp thread in the inner wall 7 of the casing and the continuous line indicates the warp thread in the outer wall 6 of the casing. It appears from the figure that one and the same warp thread extends substantially straight across the end face of the receptacle by virtue of the total twisting of 180° of the casing portions, whereby it is obvious that the warp thread is not exposed to a strain equally high as in case the warp thread were turned at an angle of 180° on the ring 4. The warp thread 8 extends between the periphery of the valve 3 and the ring 4, as appears from FIG. 5.

As a result of the twisting of the end portions at an angle of about 180°, the valve 3 is automatically locked in the central opening of the end face, because the casing exerts a low pressure in the direction towards the central line of the receptacle when the receptacle is filled up. For the same reason, the ring 4 is not at all exposed to any kind of strains.

The receptacle according to the invention is manufactured in such a manner that the hose (circular fabric) having a length essentially double in comparison with the finished receptacle is passed through a rope loop until the loop is positioned in the middle of the hose. The half of the hose passed through the loop is thereafter turned over 180° around the central line of the receptacle, turned inside out and drawn over the other half, which is thereafter provided with an inner bag, the valve of which is positioned in the rope loop. Finally, the end portions of the hose are bound together e.g. by means of a rope.

In the embodiment described above, both the outer and the inner walls of the casing are twisted to the same extent in the same direction. However, it is possible to obtain essential advantages when only one wall is in the twisted state and when the walls are twisted to different degrees. As already mentioned, the advantages of the invention become apparent even with small twisting angles. The advantages, however, become more apparent while increasing the total twisting angle up to 180°, at which angle maximum advantages are obtained. Besides liquids, the receptacle according to the invention can also be used for gases and bulk goods. In certain cases, the ring 4 can even be left out. In addition, it is selfevident that the casing does not necessarily need to be manufactured of a seamless hose but the casing can consist of two or more parts connected to each other.

I claim:

1. A flexible receptacle for fluids, said receptacle comprising a substantially cylindrical outer casing having two end faces and one mantle face and an inner bag positioned within said casing, said bag being provided with filling and emptying means, said casing being formed by a hose which is turned inside out upon itself thereby providing an inner wall and an outer wall, whereby that end face of said casing positioned adjacent to a folding line of the hose along which said hose is doubled up is twisted around the central axis of the receptacle.

2. The receptacle according to claim 1, wherein said end face of the casing is twisted with respect to said mantle face.

3. The receptacle according to claim 1, wherein both the outer and inner walls of said casing are in said twisted state.

4. The receptacle according to claim 3, wherein said outer and inner walls are twisted in the same direction.

5. The receptacle according to claim 3, wherein said outer and inner walls are twisted to the same degree.

6. The receptacle according to claim 4, wherein the total twisting angle for said outer and inner walls is within the range of 100° to 200°.

7. The receptacle according to claim 1, wherein said casing is provided with an opening for said filling and emptying means disposed in that end face of the receptacle where said casing is doubled up and twisted around said central axis.

* * * * *